US010311827B2

(12) United States Patent
Yu et al.

(10) Patent No.: US 10,311,827 B2
(45) Date of Patent: Jun. 4, 2019

(54) INTEGRATED CIRCUIT BOARD AND DISPLAY APPARATUS

(71) Applicants: BOE TECHNOLOGY GROUP CO., LTD., Beijing (CN); K-TRONICS (SU ZHOU) TECHNOLOGY CO., LTD., Suzhou, Jiangsu Province (CN)

(72) Inventors: Shuhuan Yu, Beijing (CN); Xiao Zhang, Beijing (CN); Lijie Zhang, Beijing (CN); Xitong Ma, Beijing (CN); Peng Cheng, Beijing (CN)

(73) Assignees: BOE TECHNOLOGY GROUP CO., LTD., Beijing (CN); K-TRONICS (SU ZHOU) TECHNOLOGY CO., LTD., Suzhou, Jiangsu Province (CN)

( * ) Notice: Subject to any disclaimer, the term of this patent is extended or adjusted under 35 U.S.C. 154(b) by 209 days.

(21) Appl. No.: 14/761,753

(22) PCT Filed: Sep. 30, 2014

(86) PCT No.: PCT/CN2014/087915
§ 371 (c)(1),
(2) Date: Jul. 17, 2015

(87) PCT Pub. No.: WO2015/192541
PCT Pub. Date: Dec. 23, 2015

(65) Prior Publication Data

US 2016/0253978 A1 Sep. 1, 2016

(30) Foreign Application Priority Data

Jun. 19, 2014 (CN) ..... 2014 2 0330231 U

(51) Int. Cl.
*G09G 5/00* (2006.01)
*G09G 3/00* (2006.01)
*G09G 3/20* (2006.01)

(52) U.S. Cl.
CPC ..... *G09G 5/006* (2013.01); *G09G 3/006* (2013.01); *G09G 3/2092* (2013.01);
(Continued)

(58) Field of Classification Search
CPC ... G06Q 10/06; G06F 3/0346; G06F 17/5077; G06K 19/07; G09G 2300/0426;
(Continued)

(56) References Cited

U.S. PATENT DOCUMENTS 7,340,659 B2 * 3/2008 Balakrishnan ... G01R 31/31704 714/726
2007/0079348 A1 * 4/2007 King ..... G06F 3/023 725/117

(Continued)

FOREIGN PATENT DOCUMENTS

CN 102685431 A 9/2012
CN 202495998 A 10/2012

(Continued)

OTHER PUBLICATIONS

International Search Report dated Mar. 24, 2015; PCT/CN2014/087915.

(Continued)

*Primary Examiner* — Yingchun He
(74) *Attorney, Agent, or Firm* — Ladas & Parry LLP; Loren K. Thompson

(57) ABSTRACT

There is provided an IC board and a display apparatus. Switching components (01; 02) are added between the internal interfaces (J1, J2 . . . Jn; j1, j2 . . . jn) corresponding to the backend data processing chips (U2; U3) and the frontend data processing chip (U1), or a switching component (02) is added between the internal interfaces (j1, j2 . . . jn) corresponding to the backend data processing chip (U2) and another backend data processing chip (U3). The (Continued)

switching components (01; 02) can ensure normal signal transmission between the backend data processing chips (U2; U3) and the frontend data processing chip (U1) or between the backend data processing chips (U2; U2) when no external test signal is input into the internal interfaces, i.e., when the IC board operates normally; and interrupt the signal transmission between the backend data processing chips (U2; U3) and the frontend data processing chip (U1) or between the backend data processing chips (U2; U3) when the internal interfaces j1, j2 . . . jn are input with an external test signal such that the impedance of the signal transmission path in the backend data processing chips (U2; U3) during the external testing remains consistent to avoid abnormal transmission of the external test signals and the signals during normal operation.

14 Claims, 3 Drawing Sheets

(52) U.S. Cl.
CPC . *G09G 2300/0426* (2013.01); *G09G 2360/06* (2013.01); *G09G 2370/12* (2013.01)

(58) Field of Classification Search
CPC ..... G09G 2360/06; G09G 3/2092; G09G 2370/12; H04B 10/077; H01L 2224/16145; H01L 2924/0002; H01L 2924/00; H04W 28/08
USPC ..... 345/519
See application file for complete search history.

(56) References Cited

U.S. PATENT DOCUMENTS

| | | | | |
|---|---|---|---|---|
| 2007/0198884 | A1 | 8/2007 | Ni | |
| 2008/0074555 | A1* | 3/2008 | Chen | H04N 9/641 348/720 |
| 2010/0283532 | A1* | 11/2010 | Horan | G09G 5/003 327/530 |
| 2012/0013807 | A1* | 1/2012 | Arora | H04N 5/268 348/705 |
| 2015/0234770 | A1* | 8/2015 | Koyanagi | G06F 13/4081 710/302 |

FOREIGN PATENT DOCUMENTS

| | | | |
|---|---|---|---|
| CN | 203910229 | U | 10/2014 |
| JP | 2007-147352 | A | 6/2007 |
| JP | WO/2014/049686 | * | 4/2014 |

OTHER PUBLICATIONS

Written Opinion of the International Searching Authority dated Mar. 24, 2015; PCT/CN2014/087915.

* cited by examiner

INTEGRATED CIRCUIT BOARD AND DISPLAY APPARATUS

TECHNICAL FIELD OF THE DISCLOSURE

The present disclosure relates to the field of circuit design, and particularly to an integrated circuit (IC) board and a display apparatus.

BACKGROUND

Currently, a display apparatus such as a liquid crystal television uses an IC board to process display signals. Various data processing chips are integrated on the IC board, and the data processing chips are connected through internal interfaces. During the normal operation of the IC circuit board, various input signals are received by an external connection interface CN1 from external signal sources.

In practical applications, a certain module in the IC board usually needs to be tested. In this case, a certain internal interface will be plugged into an external test circuit, and external test signals are acquired or input into the module to be tested via the internal interface.

SUMMARY

Embodiments of the present disclosure provide an IC board and a display apparatus, which can address the issue of signal transmission exception of existing IC boards when being tested.

According to one aspect of the present disclosure, there is provided an integrated circuit board comprising at least one frontend data processing chip, at least one backend data processing chip, at least one external connection interface connected to the at least one frontend data processing chip, and at least one internal interface connected to each of the at least one backend data processing chip, wherein the integrated circuit board further comprises at least one switching component connected to all internal interfaces of the at least one backend data processing chip;

in a case in which the internal interfaces are not connected with an external test signal, the backend data processing chip is connected to the frontend data processing chip or another backend data processing chip through the switching component connected to the corresponding internal interfaces; and in a case in which the internal interfaces are connected with an external test signal, the switching component connected to the internal interfaces for receiving the external test signal interrupts the connection between the backend data processing chip corresponding to the internal interfaces and the frontend data processing chip or the connection between the backend data processing chip corresponding to the internal interfaces and another backend data processing chip.

In the above IC board provided by an embodiment of the present disclosure, a switching component is added between the internal interfaces corresponding to a backend data processing chip and a frontend data processing chip, or between the internal interfaces corresponding to a backend data processing chip and another backend data processing chip. The switching component can ensure normal signal transmission between the backend data processing chip and the frontend data processing chip or between the backend data processing chips when no external test signal is input into the internal interfaces, i.e., when the IC board operates normally; and interrupt the signal transmission between the backend data processing chip and the frontend data processing chip or between the backend data processing chips when the internal interfaces are input with an external test signal such that the impedance of the signal transmission paths in the backend data processing chip during the external testing remains consistent to avoid abnormal transmission of the external test signals and the signals during normal operation.

In a possible implementation, in the above IC board provided by an embodiment of the present disclosure, the number of the backend data processing chips is at least two, and all internal interfaces of each of the backend data processing chips are connected to at least one switching component.

In a possible implementation, in the above IC board provided by an embodiment of the present disclosure, the switching component is a switching device.

In a possible implementation, in the above IC board provided by an embodiment of the present disclosure, the switching component is a relay.

In a possible implementation, in the above IC board provided by an embodiment of the present disclosure, the switching component is a metal oxide semiconductor field effect (MOSFET) transistor.

In a possible implementation, in the above IC board provided by an embodiment of the present disclosure, the external connection interface is a high definition multimedia interface HDMI, the switching component is a PMOS transistor, a source of the PMOS transistor receives a signal subjected to the processing of the frontend data processing chip in a normal operation, a gate of the PMOS transistor is connected to a hot plug detect signal HTPDN pin of the HDMI, and a drain of the PMOS transistor is connected to the internal interfaces connected to the backend data processing chip to be tested.

In a possible implementation, in the above IC board provided by an embodiment of the present disclosure, the integrated circuit board is a display driving circuit board.

An embodiment of the present disclosure also provides a display apparatus comprising the above integrated circuit board provided by an embodiment of the present disclosure.

DETAILED DESCRIPTION

In the following, specific implementations of the IC boards and the display apparatus provided by embodiments of the present disclosure are described in detail in connection with figures.

The shapes and sizes of modules in the IC boards in the figures do not reflect real scale, but are only for illustrating the content of the present disclosure.

Figure 1:
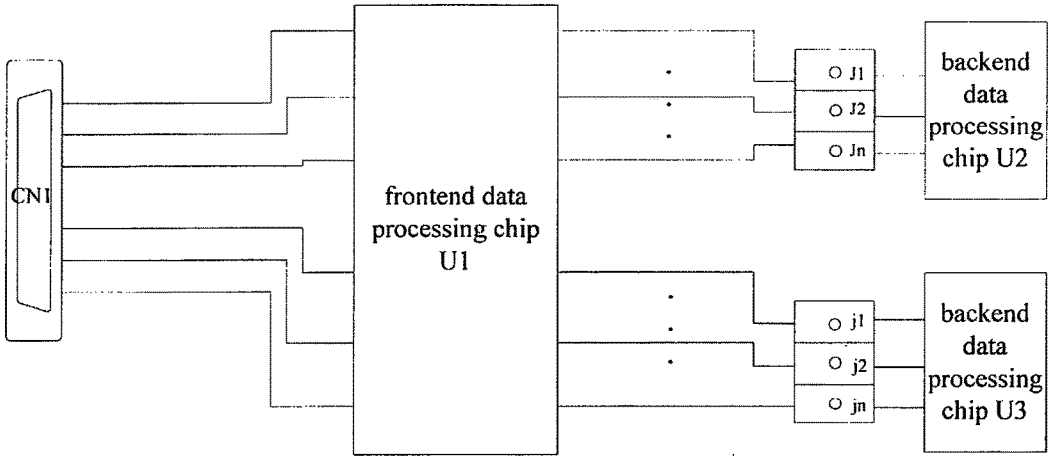
FIG. 1 is a schematic structural diagram of an IC board.

Taking the IC board illustrated in FIG. 1 as an example, the IC board specifically comprises: a frontend data processing chip U1, backend data processing chips U2 and U3, an external connection interface CN1 connected to the frontend data processing chip U1, internal interfaces J1, J2 . . . Jn connected between the frontend data processing chip U1 and the backend data processing chip U2, and internal interfaces j1, j2 . . . jn connected between the backend data processing chip U2 and the backend data processing chip U3. During normal operation of the IC board, various input signals transmitted by an external signal source(s) are received by the external connection interface CN1. The input signals are converted into other signals which can be used by the backend data processing chips U2 and U3 after being subjected to the processing of the frontend data processing chip U1, and then the converted signals are transmitted through the internal interfaces J1, J2 . . . Jn and j1, j2 . . . jn to the backend data processing chips U2 and U3 for processing.

In practical applications, a certain module in the IC board usually needs to be tested. For example, if the backend data processing chips U2 and U3 in the IC board illustrated in FIG. 1 need to be tested, the internal interfaces J1, J2 . . . Jn and j1, j2 . . . jn will be plugged into an external test circuit, and external test signals for the backend data processing chips U2 and U3 are acquired or input through the internal interfaces J1, J2 . . . Jn and j1, j2 . . . jn. Now, since the backend data processing chips U2 and U3 receive the signal sent from the frontend data processing chip U1 through the internal interfaces J1, J2 . . . Jn and j1, j2 . . . jn simultaneously, the impedance of the signal transmission paths in the backend data processing chips U2 and U3 increases, resulting in transmission exception for both of the external text signal and the signal for normal operation.

Figure 2A:
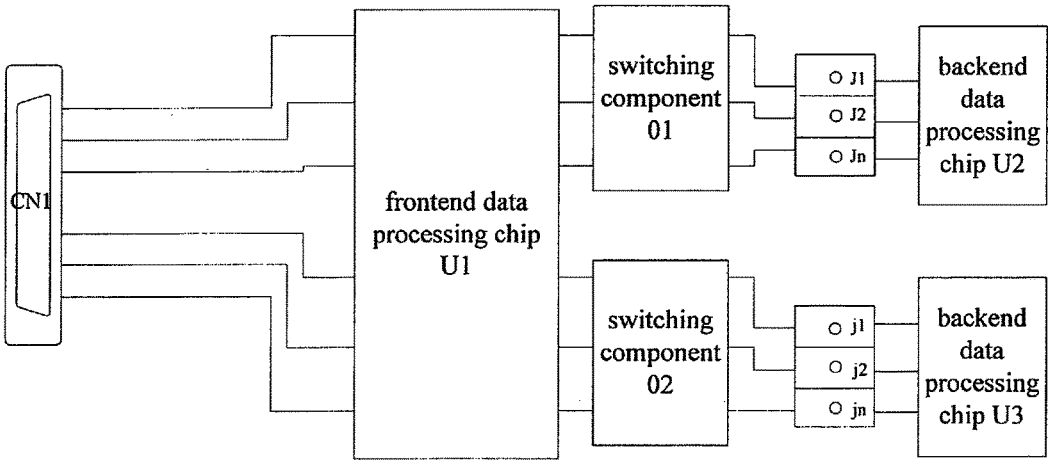
FIG. 2*a* and FIG. 2*b* are schematic structural diagrams of IC boards provided by embodiments of the present disclosure respectively.
Figure 2B:
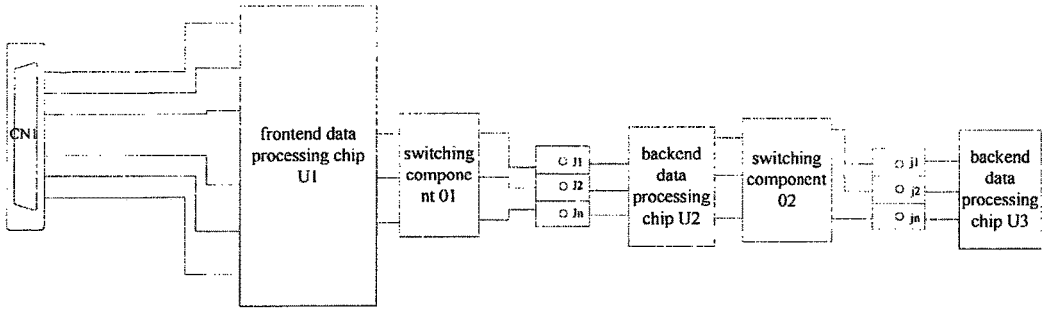

As illustrated in FIG. 2*a* and FIG. 2*b*, a IC board provided by an embodiment of the present disclosure comprises at least one frontend data processing chip U1, at least two backend data processing chips U2 and U3, at least one external connection interface CN1 connected to the at least one frontend data processing chip, internal interfaces J1, J2 . . . Jn connected to the backend data processing chip U2, and internal interfaces j1, j2 . . . jn connected to the backend data processing chip U3, wherein the IC board further comprises switching components 01 and 02 respectively connected to all internal interfaces J1, J2 . . . Jn and j1, j2 . . . jn of the backend data processing chips U2 and U3.

In FIG. 2*a*, a case in which the two backend data processing chips U2 and U3 are connected to the frontend data processing chip U1 through the internal interfaces J1, J2 . . . Jn and the internal interfaces j1, j2 . . . jn respectively is taken as an example for illustration. In FIG. 2*b*, a case in which the backend data processing chip U2 is connected to the frontend data processing chip U1 through the internal interfaces J1, J2 . . . Jn and the backend data processing chip U3 is connected to the backend data processing chip U2 through the internal interfaces j1, j2 . . . jn is taken as an example for illustration.

In a case in which no external test signal is input into the internal interfaces j1, j2 . . . jn, the backend data processing chip U3 is connected to the frontend data processing chip U1 (as illustrated in FIG. 2*a*) or the backend data processing chip U2 other than itself (as illustrated in FIG. 2*b*) via the switching 02 to which the corresponding internal interfaces j1, j2 . . . jn are connected.

In a case in which an external test signal is input into the internal interfaces j1, j2 . . . jn, the switching component 02 connected to the internal interfaces j1, j2 . . . jn input with the external test signal disconnects the connection between the backend data processing chip U3 corresponding to the internal interfaces j1, j2 . . . jn and the frontend data processing chip U1 (as illustrated in FIG. 2*a*), or disconnects the connection between the backend data processing chip U3 corresponding to the internal interfaces j1, j2 . . . jn and the backend data processing chip U2 other than the backend data processing chip U3 (as illustrated in FIG. 2*b*).

FIG. 2*a* and FIG. 2*b* only exemplarily illustrate an IC board of the present disclosure by taking a case in which there are one frontend data processing chip U1 and two backend data processing chips U2 and U3 as an example. In practical applications, an IC board may comprise multiple frontend data processing chips and multiple backend data processing chips, signal transmission may exist between the backend data processing chips, and signal transmission may also exist between the frontend data processing chips and the backend data processing chips. The connections of components in the IC board can all be configured according to the above-described connection relations of embodiments of the present disclosure, which will not be repeated here.

In addition, in FIG. 2*a* and FIG. 2*b*, a case in which all the internal interfaces of the backend data processing chips U2 and U3 are connected to the corresponding frontend (backend) data processing chips other than themselves through the switching components 01 and 02 is taken as an example for illustration. That is, in a specific implementation, there are at least two backend data processing chips, and all internal interfaces of each backend data processing chip are connected to at least one switching component. However, in a practical operation, it is also possible to configure corresponding switching components based on the requirements for testing backend data processing chips such that no switching component is disposed at a backend data processing chip for which no external test is required, and a switching component is disposed at a backend data processing chip for which an external test is required. The configuration manner is not limited herein.

In the above IC board provided in the embodiment of the present disclosure, as illustrated in FIG. 2*a*, the switching component 02 is added between the internal interfaces j1, j2 . . . jn corresponding to the backend data processing chip U3 and the frontend data processing chip U1, or as illustrated in FIG. 2*b*, the switching component 02 is added between the internal interfaces j1, j2 . . . jn corresponding to the backend data processing chip U3 and another backend data processing chip U2. The normal signal transmission between the backend data processing chip U3 and the frontend data processing chip U1 or that between the backend data processing chips U3 and U2 is ensured by the switching component 02 when no external test signal is input into the internal interfaces j1, j2 . . . jn, i.e., when the IC board operates normally; and the signal transmission between the backend data processing chip U3 and the frontend data processing chip U1 or that between the backend data processing chips U3 and U2 is interrupted when an external test signal is inputted to the internal interfaces j1, j2 . . . jn, such that the impedance of the signal transmission path in the backend data processing chip U3 during the external testing remains consistent to avoid abnormal transmission of the external test signals and the signals during normal operation.

Figure 3:
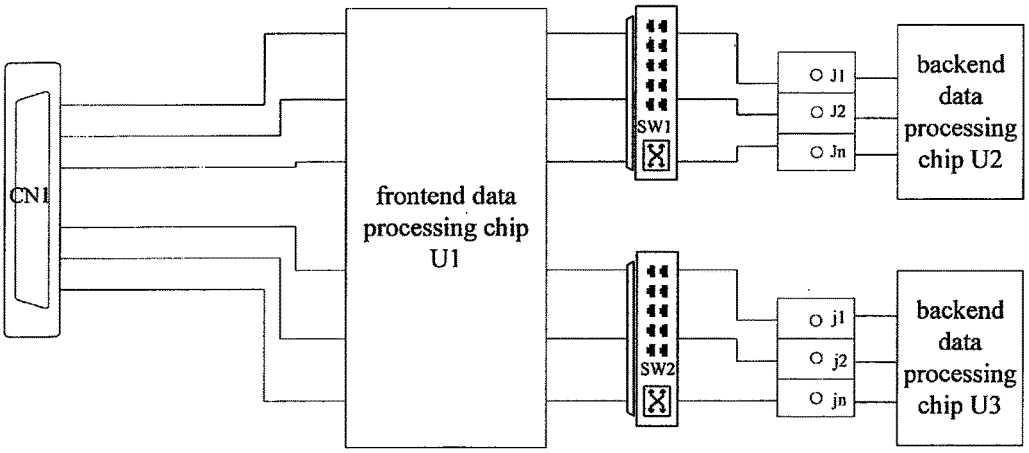
FIG. 3 is a first specific structural diagram of an IC board provided by an embodiment of the present disclosure.

In a specific implementation, in the above IC board provided by an embodiment of the present disclosure, the switching components 01 and 02 can specifically be switching devices SW1 and SW2 illustrated in FIG. 3, relays, or metal oxide semiconductor field effect transistors (MOSFET) Q1, Q2 . . . Qn, and q1, q2 . . . illustrated in FIG. 4, which are not limited herein.

In a specific implementation, in a case in which the switching components 01 and 02 are switching devices SW1 and SW2 as illustrated in FIG. 3, when the IC board operates normally, the internal interfaces J1, J2, . . . Jn and j1, j2 . . . jn are not connected with an external test circuit, and the switching devices SW1 and SW2 are closed; when an input signal transmitted by the external signal source is received by the external connection interface CN1, the input signal is converted into another signal that can be used by the backend data processing chips U2 and U3 after being subjected to the processing of the frontend data processing chip U1, and then transmitted to corresponding backend data processing chips U2 and U3 for data processing through the closed switching device SW1 and SW2 and the internal interfaces J1, J2 . . . Jn and j1, j2 . . . jn. In a case in which the backend data processing chip U3 needs to be tested, the internal interface j1, j2 . . . jn can be plugged into the external test circuit, and the internal interfaces j1, j2 . . . jn can be used to input or obtain external test signals for the backend data processing chip U3; at this time, the switching device SW2 needs to be opened to cut off the signal path from the frontend data processing chip U1 to the backend data processing chip U3 such that no interference exists in the transmission path of the external test signals to the backend data processing chip.

Figure 4:
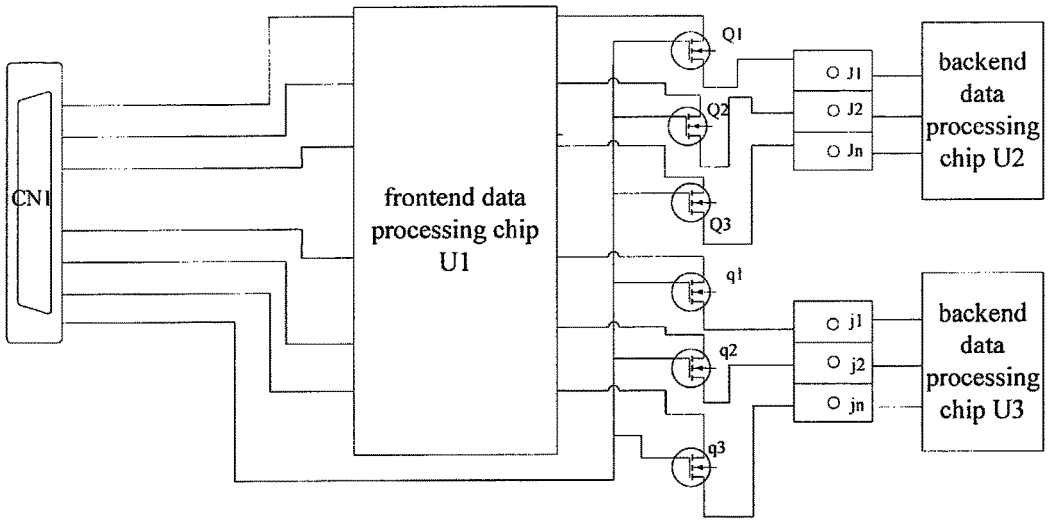
FIG. 4 is a second specific structural diagram of an IC board provided by an embodiment of the present disclosure.

In a specific implementation, in a case in which the external connection interface CN1 in the IC board is high definition multimedia interface (HDMI), as illustrated in FIG. 4, the switching components 01 and 02 can be specifically configured as PMOS transistors, wherein the source of the PMOS transistor can receive a signal subjected to the processing of the frontend data processing chip U1 in a normal operation, the gate can be connected to the hot plug detect signal (HTPDN) pin, and the drain can be connected to an internal interface connected to the backend data processing chip U3 to be tested.

When the IC board operates normally, the internal interfaces J1, J2 . . . Jn and j1, j2 . . . jn are not connected to the external test circuit, the external connection interface CN1 receives a HDMI signal, and now the signal HTPDN as an arbitration signal is at a low level to turn on respective PMOS transistors. The HDMI signal received by the external connection interface CN1 is converted into another signal that can be used by the backend data processing chips U2 and U3 after being subjected to the processing of the frontend data processing chip U1, and then transmitted to corresponding backend data processing chips U2 and U3 for data processing through the turned-on PMOS transistors and the internal interfaces J1, J2 . . . Jn and j1, j2 . . . jn.

When the backend data processing chip U3 needs to be tested, the internal interface j1, j2 . . . jn can be plugged into the external test circuit, and the internal interfaces j1, j2 . . . jn can be used to input or obtain external test signals for the backend data processing chip U3. Now, no HDMI signal is inputted to the external connection interface CN1, and the HTPDN is in a high impedance state, that is, the PMOS transistors are turned off, to cut off the signal transmission path from the frontend data processing chip U1 to the backend data processing chip U3 such that no interference exists in the transmission path of the external test signals to the backend data processing chip.

In a practical implementation, the above IC board provided by the embodiment of the present disclosure can be applied to a display panel, that is, the IC board can specifically be a display driving circuit board. In particular, it can be applied in a display driving circuit board of a liquid crystal display panel, or can also be applied in a display driving circuit board of an organic electroluminescent display panel, which is not limited herein.

Based on the same inventive concept, an embodiment of the present disclosure also provides a display apparatus comprising the above IC board provided by an embodiment of the present disclosure. The display apparatus can be any product or component with display function, such as a cell phone, a tablet computer, a television, a display, a notebook computer, a digital photo frame, a navigator among others. The implementation of the display apparatus can refer to the embodiments of the above IC board, which will not repeated here.

In the above IC board and display apparatus provided by embodiments of the present disclosure, a switching component is added between the internal interfaces corresponding to a backend data processing chip and a frontend data processing chip, or between the internal interfaces corresponding to a backend data processing chip and another backend data processing chip. The switching component can ensure normal signal transmission between the backend data processing chip and the frontend data processing chip or between the backend data processing chips when no external test signal is input into the internal interfaces, i.e., when the IC board operates normally; and interrupt the signal transmission between the backend data processing chip and the frontend data processing chip or between the backend data processing chips when the internal interfaces are input with an external test signal such that the impedance of the signal transmission path in the backend data processing chip during the external testing remains consistent to avoid abnormal transmission of the external test signals and the signals during normal operation.

Obviously, those skilled in the art can make various modifications and variations to the embodiments of the present disclosure without departing from the spirit and scope of the present disclosure. As such, if those modifications and variations to the embodiments of the present disclosure fall in the scope of the claims and their equivalents of the present disclosure, the present disclosure is intended to comprise those modifications and variations.

The present application claims the priority of Chinese Patent Application No. 201420330231.4 filed on Jun. 19, 2014, and the entire content of which is incorporated as a part of the present invention by reference.

What is claimed is:

1. An integrated circuit board, comprising at least one frontend data processing chip, at least one backend data processing chip, at least one external connection interface connected to the at least one frontend data processing chip, and at least one internal interface connected to the at least one backend data processing chip, wherein the integrated circuit board further comprises at least one switching component, wherein the at least one internal interface, which is connected to a backend data processing chip, is further connected to at least one frontend data processing chip or to another backend data processing chip via the at least one switching component;

in a case in which the backend data processing chip is in a normal operation, the backend data processing chip is configured to communicate with the at least one frontend data processing chip or with the another backend data processing chip via the internal interface to which the backend data processing chip is connected and the switching component; and in a case in which the backend data processing chip needs to be tested, the backend data processing chip to be tested is configured to receive a test signal from an external test circuit via the internal interface to which the backend data processing chip to be tested is connected, wherein the internal interface being plugged into the external test circuit to receive the test signal, and the switching component is configured to interrupt a communication connection between the backend data processing chip to be tested and the frontend data processing chip or that between the backend data processing chip to be tested and the another backend data processing chip;

wherein the at least one external connection interface is a high definition multimedia interface HDMI, and the switching component is a transistor; a source of the transistor is configured to receive a signal subjected to the processing of the frontend data processing chip in a normal operation, a gate of the transistor is connected to a hot plug detect signal HTPDN pin of the HDMI, and a drain of the transistor is connected to the internal interfaces connected to the backend data processing chip to be tested.

2. The integrated circuit board of claim 1, wherein the number of the backend data processing chips is at least two, and all internal interfaces of each of the backend data processing chips are connected to at least one switching component.

3. The integrated circuit board of claim 1, wherein the switching component is a switching device.

4. The integrated circuit board of claim 1, wherein the switching component is a relay.

5. The integrated circuit board of claim 1, wherein the switching component is a metal oxide semiconductor field effect transistor.

6. The integrated circuit board of claim 5, wherein the switching component is a PMOS transistor.

7. The integrated circuit board of claim 1, wherein the integrated circuit board is a display driving circuit board.

8. A display apparatus comprising an integrated circuit board of claim 1.

9. The display apparatus of claim 8, wherein the number of the backend data processing chips is at least two, and all internal interfaces of each of the backend data processing chips are connected to at least one switching component.

10. The display apparatus of claim 8, wherein the switching component is a switching device.

11. The display apparatus of claim 8, wherein the switching component is a relay.

12. The display apparatus of claim 8, wherein the switching component is a metal oxide semiconductor field effect transistor.

13. The display apparatus of claim 12, wherein the switching component is a PMOS transistor.

14. The display apparatus of claim 8, wherein the integrated circuit board is a display driving circuit board.

* * * * *